United States Patent [19]

Ehmann

[11] 4,284,091

[45] Aug. 18, 1981

[54] HAIR CURLER

[76] Inventor: Willy Ehmann, Friedrichstrasse 8a, D-6900 Heidelberg, Fed. Rep. of Germany

[21] Appl. No.: 917,017

[22] Filed: Jun. 19, 1978

[30] Foreign Application Priority Data

Oct. 31, 1977 [DE] Fed. Rep. of Germany ..... 2748764

[51] Int. Cl.[3] ..... A45D 2/00

[52] U.S. Cl. ..... 132/40

[58] Field of Search ..... 132/40, 42, 41, 33 R, 132/46 A, 48 R

[56] References Cited

U.S. PATENT DOCUMENTS

| | | | |
|---|---|---|---|
| 476,824 | 6/1892 | Scelley | 132/42 R |
| 732,566 | 6/1903 | Koenig | 132/48 R |
| 1,190,980 | 7/1916 | Boyers | 132/40 |
| 2,176,351 | 10/1939 | McFadden | 132/40 |
| 2,243,397 | 5/1941 | Schwab | 132/33 R |
| 2,469,576 | 5/1949 | Ritter | 132/48 R |
| 2,482,052 | 9/1949 | Zachary | 132/40 X |
| 2,551,535 | 5/1951 | Grow | 132/33 R |
| 2,783,763 | 3/1967 | King | 132/34 R |
| 2,884,932 | 5/1959 | Solomon | 132/42 R |
| 3,587,595 | 6/1971 | Popeil | 132/46 A |

*Primary Examiner*—G. E. McNeill

[57] ABSTRACT

A hair curler comprises an elongate member having a generally helical rib extending therealong and defining depressions between the convolutions of the helical rib for receiving a tress of hair wound around the elongated member, and a clasp member adapted to be secured around the elongate member for retaining the reset of hair in the depressions.

2 Claims, 4 Drawing Figures

HAIR CURLER

The present invention relates to a hair curler for the curling of hair tresses into corkscrew-like curls.

Hair curlers exist in the most varied forms, the most usual consisting of a cylindrical body of a relatively rigid material, suchh as wire mesh, plastics or a resilient foam material. With all of these hair curlers, a tress of hair is wound around the cylindrical body, dried thereon and subsequently combed out. However, it is relatively difficult to form corkscrew-like curls with such hair curlers. To form corkscrew curls, the hair tress is wound in helical form around the cylindrical body, rather than being wound in superposed layers. In order to achieve curls which are as uniform as possible in this manner, the helical winding around the hair curler has to be performed very carefully.

It is an object of this invention to provide a hair curler for producing corkscrew curls, with which the winding of the hair tresses is easier than with known curlers, and which produce a uniform fall of combed-out corkscrew curls after drying of the hair.

The above and other objects are accomplished in accordance with the invention with a hair curler comprising an elongate member having a generally helical rib extending therealong and defining depressions between convolutions of the helical rib for receiving a tress of hair wound around the elongate member, and a clasp member adapted to be secured around the elongate member for retaining the tress of hair in a selected depression.

Such a hair curler gives the user the possibility of uniformly winding the hair tress into the depressions between the convolutions of the helically extending rib, downwardly from the top, that is to say towards the hair ends. By means of the clasp member, the free end of the hair tress can be secured in the depression of the corresponding rib convolution. The winding of the hair tress is thus essentially simplified and can be performed faster and more uniformly than hitherto.

The above and other objects, advantages and features of the present invention will be more fully understood by reference to the following detailed description of now preferred embodiments thereof, taken in conjunction with the accompanying drawing wherein FIG. 1 is a side view of a hair curler according to one embodiment of the invention;

In its simplest form, the hair curler consists of a rod 1 with a rib 2 helically extending around its surface. The convolutions of the rib 2 define depressions into which the hair tress to be shaped into curls is wound from the top downwardly. In the illustrated embodiment, the convolutions are of equal pitch. It is, however, alternatively conceivable that the pitch of the rib convolutions decreases downwardly, whereby a tighter curling of the ends of the hair tress is obtained. The rod 1 may also be slightly conically shaped.

Eye 3 is provided at the upper end of rod 1 and a hair clip or other fixing member (not illustrated) can be received in eye 3 so that the hair curler can be retained near the scalp or at a desired position of the hair.

Figure 4:
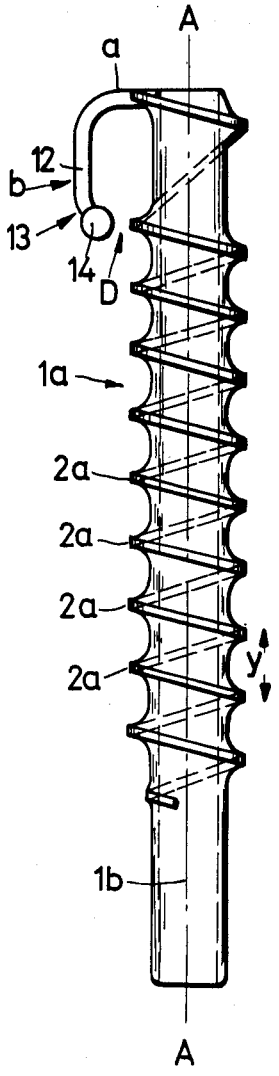
FIG. 4 is a side view of another embodiment of the hair curler of the invention.

In another embodiment, illustrated in FIG. 4, instead of an eye, the upper end of the rod is provided with an L-shaped hook 12 the leg a of which extends perpendicularly from rod 1*a* and the leg b of which extends substantially parallel to the axis A—A of the rod. Hook leg b is longer than leg a and its free end 13 is directed inwardly towards the rod and terminates in a ball 14 which is positioned in radial alignment with a region of the helical rib 2*a*, there being a narrow passageway D between ball 14 and the rod, through which a hair tress can be passed, the hook thus serving to hold the hair curler on the hair. Also, as will be seen from FIG. 4, the lower end of rod 1*a* is smooth, that is to say it is free of the helical rib. The end of a wound tress of hair may be held in position on this smooth end by the clasp member.

Elongate member 1 may be a solid rod or a tube (not illustrated) and its wall may be perforated (not illustrated). It may be rigid or flexible and is preferably made of a light material in order that the weight on the head of the person being treated can be kept as low as possible.

A clasp member 4 with the aid of which the hair tress wound around the rod 1 can be fixed, is provided. An advantageous embodiment of such a clasp member 4 consists of a ring 5 composed of two semi-circular ring components a and b. The two half ring components a and b are interconnected at one end by hinge 6. At the free ends of ring components a and b remote from the hinge, a catch is provided.

In the illustrated embodiment, this catch consists of a pin releasably detainable in a hole. For this purpose, a radially projecting lug 7 with a hole 8 is provided on the free end of the ring component a, remote from the hinge 6. At the free end of the other ring component b remote from the hinge 6, a radially projecting lug 9 which corresponds to the first lug 7, is provided, having a pin 10. This pin 10 is so arranged that, when the lugs 7 and 9 are adjacent on closing of semi-circular ring components a and b, it registers with the hole 8 of the lug 7 and enters into this hole and can releasably engage therein with a detent action. The height x of ring 5 preferably corresponds to pitch y of one rib convolution so that, on fixing of the closure piece 4, the hair tress lying in the corresponding depression of the convolution is retained. The ring 5 is opened by withdrawing the pin 10 from the hole 8, and it can then be removed from the rod 1. The shell of the ring 5 is perforated by holes 11 through which liquid from the wet hair and drying air can pass.

Figure 1:
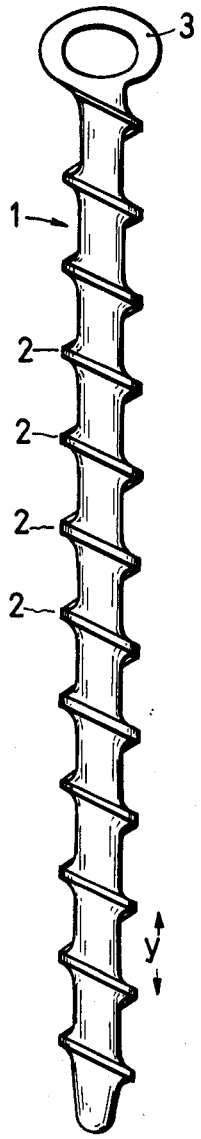
Figure 2:
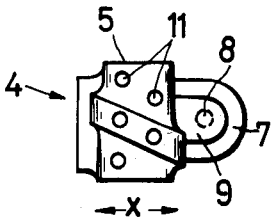
FIG. 2 is a side view of a clasp member.
Figure 3:
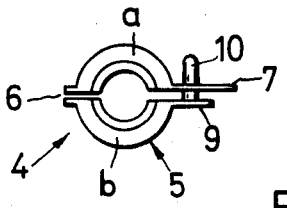
FIG. 3 is a plan view of the clasp member of FIG. 2.

As will be seen from FIG. 2, the ring components of the clasp member are provided with helical formations which can mate with the helical rib on the rod, these helical formations defining a helically extending groove at the interior of the clasp member.

What I claim is:

1. A hair curler comprising a generally cylindrical elongate member having a generally helical rib extending therealong and defining generally cylindrical depressions between the convolutions of the helical rib for receiving a tress of hair wound around the elongate member; a separate and generally annular clasp member adapted to be secured around the elongate member for retaining a free end of the tress of hair on one end of the elongate member, the clasp member comprising a ring composed of two semi-circular ring components, a hinge interconnecting the two ring components at one of their ends, and a catch for connecting the two ring components at the other end of their ends; and an L-shaped hook at an end of the elongate member opposite the one end thereof for retaining the elongate member on the tress of hair, the hook defining a narrow passage with the opposite end of the elongate member for introducing a tress of hair therethrough.

2. A hair curler comprising a generally cylindrical elongate member having a generally helical rib extending therealong and defining generally cylindrical depressions between the convolutions of the helical rib for receiving a tress of hair wound around the elongate member; a separate and generally annular clasp member adapted to be secured around the elongate member for retaining a free end of the tress of hair on one end of the elongate member; and an L-shaped hook at an end of the elongate member opposite the one end thereof for retaining the elongate member on the tress of hair, the hook having a leg extending substantially perpendicularly from the opposite end of the elongate member and another leg projecting from said leg substantially parallel to the elongate member, the other leg having a free, ball-shaped end directed inwardly towards the opposite elongate member end, the ball-shaped end defining a narrow passage with the opposite elongate member end.

* * * * *